United States Patent [19]

Topolcsanyi et al.

[11] Patent Number: 4,925,406

[45] Date of Patent: May 15, 1990

[54] ELECTRICAL CONNECTOR

[76] Inventors: George Topolcsanyi, 44 Tadstan Drive, Tullamarine, Victoria 3943; Salvators Dimasi, 18 Curee Avenue, Oak Park, Victoria 3046, both of Australia

[21] Appl. No.: 258,696

[22] PCT Filed: Dec. 16, 1987

[86] PCT. No.: PCT/Au87/00426

§ 371 Date: Jul. 26, 1988

§ 102(e)Date: Jul. 26, 1988

[87] PCT Pub. No.: WO88/04842

PCT Pub. Date: Jun. 30, 1988

[30] Foreign Application Priority Data

Dec. 16, 1986 [AU] Australia ..... PH9538

[51] Int. Cl.[5] ..... H01R 13/00

[52] U.S. Cl. ..... 439/839

[58] Field of Search ..... 439/837, 839, 845, 849, 439/851, 877–882

[56] References Cited

U.S. PATENT DOCUMENTS

| | | | |
|---|---|---|---|
| 3,914,008 | 10/1975 | Hollander et al. | 439/839 |
| 4,009,924 | 3/1977 | Bungo et al. | 439/839 |
| 4,032,215 | 6/1977 | Jarmofsky | 439/877 |
| 4,550,963 | 11/1985 | Moors | 439/845 |

FOREIGN PATENT DOCUMENTS

| | | | |
|---|---|---|---|
| 2363303 | 7/1974 | Fed. Rep. of Germany | 439/849 |
| 2719820 | 11/1977 | Fed. Rep. of Germany | 439/849 |
| 1353853 | 1/1964 | France | 439/849 |
| 1113856 | 5/1968 | United Kingdom | 439/849 |

*Primary Examiner*—Joseph H. McGlynn

*Attorney, Agent, or Firm*—Roylance, Abrams, Berdo & Goodman

[57] ABSTRACT

An electrical connector (1) comprising a first conenctor section (3) for connection to an electricity conducting means, and a second connector section (2) communicating with the first connector section (3), the second connector section (2) including at least two arms (5, 6) extending therefrom, each of the arms have a transverse engagement surface (8), the transverse engagement surface (8) of one of the arms being substantially parallel to the trasverse engagement surface (8) of the other of the arms and defining a contact surface for engagement with an electrical terminal.

11 Claims, 2 Drawing Sheets

ELECTRICAL CONNECTOR

The invention relates to electrical connectors in particular the type adapted for connection of leads to spark plugs, coils and distributor caps of internal combustion engines.

Traditionally, connection of a lead to a spark plug or coil has comprised a cylindrical connector which fits over and surrounds a spark plug or coil terminal. Such connectors are usually encased in elastomeric material to allow limited movement of the connector whilst maintaining a substantially water-tight seal about the spark plug or coil terminal. Therefore, it is necessary to accurately locate the terminal within the cylinder. This has been difficult to achieve where the connector is recessed well within the elastomeric material.

The cylindrical connector is usually encircled by a partial cylindrical spring clip which serves to reinforce the connection of the cylinder to the terminal. One example of this type of connector is disclosed in Australian patent 502,552 which comprises additional semi-cylindrical spring material with locating lugs to ensure positive engagement about the terminal of a spark plug. Spark plugs in current engines are commonly recessed and in view of the limited finger space it is not possible for disconnection to be accomplished by pulling about the end of the connector.

Thus to disengage the conventional electric connector assembly, one needs to pull upon the elastomeric boot or lead and, therefore, cause tension between the connector and the lead where they join. Consequently the connection between the connector and the lead can deteriorate causing intermittant electrical transfer with well-known consequences upon the ignition of the engine.

It is proposed according to a first aspect of the invention that the connector section need be neither cylindrical nor require close axial engagement of the connector and terminal.

Accordingly there is provided an electrical connector comprising a first connector section for connection to an electricity conducting means, and a second connector section communicating with the first connector section, the second connector section including at least two arms extending therefrom, each of the arms have a transverse engagement surface, the transverse engagement surface of one of the arms being substantially parallel to the transverse engagement surface of the other of the arms and defining a contact surface for engagement with an electrical terminal. To enable firm location of the terminal by the transverse engagement surfaces, they are preferably separated by a distance less than the transverse dimension of the terminal.

Preferably the engagement surfaces lie in a common plane normal to the arms and are pressed down and about the terminal. In view of the substantially parallel nature of the engagement surfaces the terminal may be located at any point therebetween avoiding the precise connection techniques characteristic of cylindrical connectors. As the terminal is not totally encircled by the connector there is no need for accurate alignment with the centre line of the surrounding boot of elastomeric material. This arrangement also assists disengagement of the connector from the terminal by angular motion minimizing the tension exerted upon the connection between the terminal and the lead.

Typically the oppositely disposed engagement surfaces are ribs or ridges. Overall in the second connector section the arms may project normal to the base to form a channel of general U-shaped appearance. The base of the second connector section may also serve as a positive limit to the terminal to prevent it being over inserted and to give the user a positive feel when the terminal is totally engaged.

The orientation of the engagement surfaces relative to the remaining portion of the connector may be varied for convenient lead connection, the important requirement being that those surfaces in use present traversely of the terminal. Similarly the actual shape of the surfaces can be varied providing they can firmly engage the terminal.

In a second aspect of the invention an improvement is provided in the known conventional connector of the type described above and illustrated in Australian patent 502,552. Accordingly an electrical connector is provided comprising a first connector section for connection to an electricity conducting means and a second connector section comprising a base section and a pair of arms extending from the base section, the base section and pair of arms defining a generally cylindrical shaped surface for engaging an electrical terminal, the base section including an open ended slot extending longitudinally of the base section.

Preferably, a reinforcement means substantially surrounds the second connector section and biases the pair of arms towards one another and holds the terminal tightly when inserted within the connector. To enhance this, the reinforcement means may be fabricated to resilient material such as spring material.

It has been found that the provision of this longitudinal open ended slot allows additional flexing about the terminal and reduces stress in the connector when a terminal is engaged or disengaged.

This additional flexing allows accommodation of both the J.I.S. and S.A.E./ISO standard terminals and permits easier axial engagement of the terminal thereby minimizing the risk of damage to the terminal and insulation elastomeric boot surrounding it during the engagement and disengagement operation.

In a third aspect of the invention there is provided an electrical connector comprising a first connector section for connection to an electricity conducting means, a second connector section for connection to an electrical terminal and stop means interposed between the first connector section and second connector section, the stop means defining a limit to which the electricity conducting means is locatable in the first connector section towards the second connector section.

Conventionally, connection to the lead is achieved by placing the electricity conducting means, e.g. a lead, within a pair of flanged arms provided on the first connector section. After location of the lead these arms are crimped together to positively engage the connector to the lead. As indicated the improvement comprises the formation of a stop means interposed between the first connector section and the second connector section. This defines the end surface to which the lead can be inserted between the arms. It has been found the provision of such a stop means protects the electricity conducting means from physical damage, cross-arcing damage, increases the interface between the electricity conducting means and the terminal and also assists in the control of assembly lengths of cable in which form the electricity conducting means is usually available.

The stop means may be integrally formed from the connector by punching part of the material to be upstanding. This is easily achieved by a stamping operation where the terminal is of metallic material.

The stop means may be incorporated into conventional connector assemblies or to be used in combination with either of the first and second aspects of the invention described above.

The drawings further illustrate the invention.

Referring to FIGS. 1 through 6 a connector assembly 1 is provided comprising a terminal connector end 2 and a lead receiving end 3.

Figure 5:
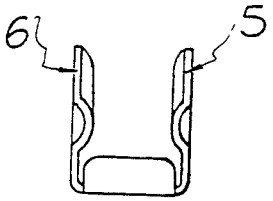
FIG. 5 is a left end view of the connector asesmbly of FIG. 1.
Figure 6:
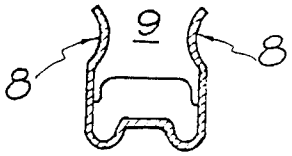
FIG. 6 is a section view along BB of FIG. 2.
Figure 7:
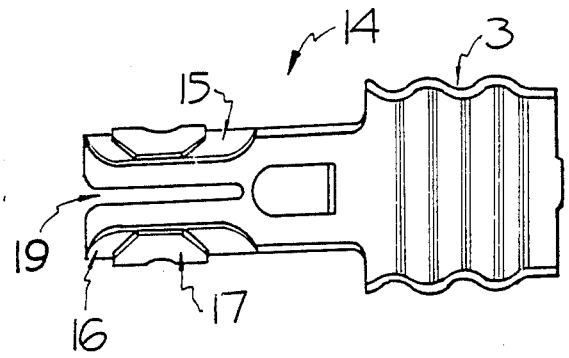
FIG. 7 is a plan view of the conductor assembly according to the second aspect of the invention.
Figure 8:
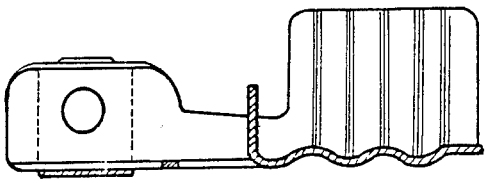
FIG. 8 is a longitudinal cross-sectional view of the connector assembly of FIG. 7.
Figure 9:
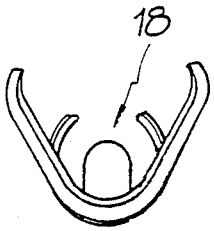
FIG. 9 is a right end view of the connector assembly of FIG. 7.
Figure 10:
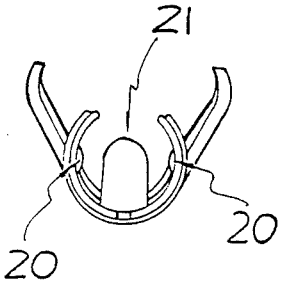
FIG. 10 is a left end view of the connector assembly of FIG. 7.

Terminal connector end 2 is of approximately U-shape as shown in FIG. 5 and has a base 4 and arms 5 and 6. In base 4 is an upstanding lug 7. Arms 5 and 6 each have an inward bent section 8 forming a channel way 9. Bent sections 8 run approximately parallel to one another.

Figure 1:
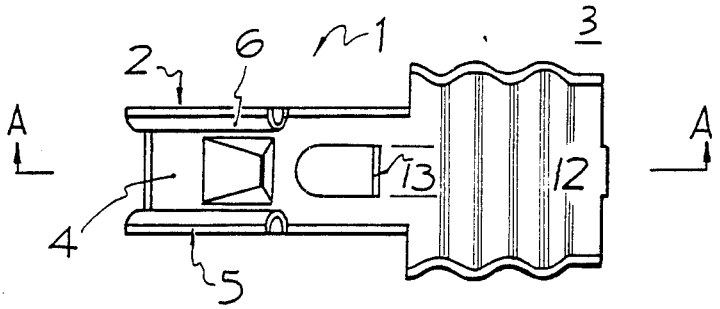
FIG. 1 is a plan view of a connector assembly according to the first aspect of the invention.
Figure 2:
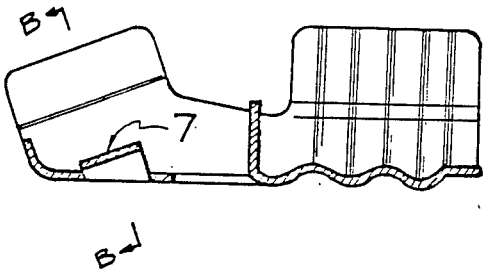
FIG. 2 is a section AA view of the connector assembly of FIG. 1.
Figure 3:
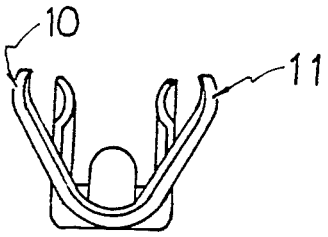
FIG. 3 is a right end view of the connector assembly of FIG. 1.
Figure 4:
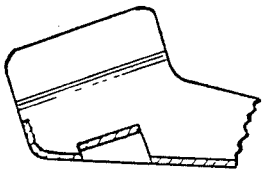
FIG. 4 is a partial view of the cross-sectional view of FIG. 2.

Lead receiving end 3, as shown in FIG. 3, comprises a pair of arms 10 and 11 having corrugations 12 running thereon. Stop 13 is formed from the assembly 1 and is approximately 90° to the longitudinal axis of assembly 1.

In use, a lead (not shown) is inserted between arms 10 and 11. The lead abuts lug 13. Thereafter arms 10 and 11 are crimped towards one another securely locating the lead therebetween.

Whilst also not shown the terminal connector end 2 is encased in elastomeric material with channel way 9 communicating with an aperture formed in the elastomeric material.

When connecting this connector assembly to a spark plug, the terminal of the spark plug is inserted in the aperture in the elastomeric material and the terminal presented to channel way 9 approximately normal to the bent sections 8. The length of bent sections 8 is large compared with the cross-section dimension of the terminal giving a large insertion area. Thus avoids the tight axial alignment characteristic of prior art terminals. As the terminal is of cross-sectional dimension greater than the distance between bent sections 8, pushing the terminal connector end down the terminal passes it through channel way 9 towards base 4. Lug 7 ensures the terminal is located in its optimum position. Bent sections 8 in the fully inserted terminal position locate upon ridges formed in the terminal thereby securing it into position. To disengage the terminal from the connector assembly it is not necessary to pull the connector assembly. Rather by angular deflection of the connector relative to the terminal, the terminal forces bent sections 8 to open outwardly allowing disengagement.

The second aspect of the invention is illustrated in FIGS. 7 to 10 in which like features to those shown in FIGS. 1 to 6 are given like numbers. Further it entails the same lead connection to assembly 14 as in FIGS. 1 to 6.

Terminal connector end 15 is provided with a cylindrical portion 16 and a surrounding tension clip 17 surrounding. Cylindrical portion 16 has an opening 18 along its entire length and a longitudinal slot 19 oppositely disposed to opening 18. A pair of dimples 20 impose into the terminal receiving cavity 21.

In use the terminal (not shown) is aligned with cylindrical portion 16 and inserted into terminal receiving cavity 21. The initial dimension of the terminal is larger than that of the cylindrical portion 16, and as it is inserted, cylindrical portion 16 flexes outward expanding slot 19, opening 18 and clip 17. The terminal is inserted until dimples 20 locate in a corresponding recess on the terminal.

The provision of longitudinal slot 19 relieves stress in cylindrical portion 16 which increases the durability of the connector assembly and gives a minimal change in terminal entry and withdrawal force for given change in terminal diameter.

We claim:

1. An electrical connector, comprising:

a first connector section for connection to an electricity conducting means; and a second connector section communicating with the first connector section for connection to an electrical terminal, the second connector section including a base section and at least two arms extending from the base section to free ends of the arms, each of the arms having a transverse engagement surface, the transverse engagement surface of one of the arms being substantially parallel to the transverse engagement surface of the other of the arms and defining a contact surface for engagement with the electrical terminal, the free ends of the arms defining an opening along lengths thereof opposite the base section through which the terminal can pass in a direction generally parallel to the engagement surfaces.

2. A connector according to claim 1, wherein the transverse engagement surface of each arm lies in a common plane normal to the arms.

3. A connector according to claim 1, wherein the transverse engagement surface is a ridge or rib.

4. A connector according to claim 1, wherein the two arms extend approximately normal from the base section.

5. A connector according to claim 4, wherein the base section includes an abuttment surface defining the limit to which the terminal is locatable in the second connector section.

6. A connector according to claim 1 wherein stop means is interposed between the first connector section and the second connector section, the stop means defining a limit to which the electricity conducting means is locatable in the first connector section towards the second connector section.

7. An electrical connector, comprising:

a first connector section for connection to an electricity conducting means; and a second connector section for connection to an electrical terminal comprising a base section and a pair of arms extending from the base section to free ends of the arms, the base section and pair of arms defining a generally partially cylindrical shaped surface for engaging the electrical terminal, the base section including an open ended slot extending longitudinally of the base section, the free ends of the arms defining an opening along lengths thereof opposite the base section through which the electrical terminal can pass in a direction generally transverse to the base section.

8. A connector according to claim 7, further comprising a reinforcement means which substantially surrounds the second connector section and biases the pair of arms towards one another.

9. A connector according to claim 8, wherein the reinforcement means is comprised of resilient material.

10. A connector according to claim 7, the open ended slot is located in the base section substantially opposite the opening defined by the ends of the pair of arms.

11. A connector according to claim 1, wherein stop means is interposed between the first connector section and the second connector section, the stop means defining a limit to which the electricity conducting means is locatable in the first connector section towards the second connector section.

* * * * *